US010233862B1

(12) United States Patent
Hoffman et al.

(10) Patent No.: US 10,233,862 B1
(45) Date of Patent: Mar. 19, 2019

(54) MARINE ENGINES HAVING A CYLINDER BLOCK WITH CYLINDER LINER

(71) Applicant: Brunswick Corporation, Lake Forest, IL (US)

(72) Inventors: Daniel P. Hoffman, Fond du Lac, WI (US); George D. Idzikowski, Lomira, WI (US)

(73) Assignee: Brunswick Corporation, Mettawa, IL (US)

( * ) Notice: Subject to any disclaimer, the term of this patent is extended or adjusted under 35 U.S.C. 154(b) by 234 days.

(21) Appl. No.: 15/353,377

(22) Filed: Nov. 16, 2016

(51) Int. Cl.

| | |
|---|---|
| ***F02B 75/22*** | (2006.01) |
| ***F02F 1/00*** | (2006.01) |
| ***F02B 61/04*** | (2006.01) |
| ***B63H 20/00*** | (2006.01) |

(52) U.S. Cl.
CPC ..... *F02F 1/004* (2013.01); *B63H 20/00* (2013.01); *F02B 61/045* (2013.01); *F02B 75/22* (2013.01); *B63B 2758/00* (2013.01); *F02F 2200/00* (2013.01)

(58) Field of Classification Search
CPC ..... F02F 1/004; F02F 2200/00; F02B 61/045; F02B 75/22; B63H 20/00; B63H 2758/00; F16J 1/04; F16J 1/02; B63B 2758/00
See application file for complete search history.

(56) References Cited

U.S. PATENT DOCUMENTS

| | | | | |
|---|---|---|---|---|
| 4,452,194 | A * | 6/1984 | Watanabe | F01M 11/04 123/195 P |
| 4,776,303 | A | 10/1988 | Hundertmark | |
| 5,134,976 | A | 8/1992 | Towner et al. | |
| 5,303,682 | A | 4/1994 | Donahue et al. | |
| 7,000,584 | B1 | 2/2006 | Wynveen et al. | |
| 7,191,770 | B1 | 3/2007 | Anderson et al. | |
| 7,240,608 | B2 * | 7/2007 | Schaefer | B22D 19/0009 164/98 |

* cited by examiner

*Primary Examiner* — Hung Q Nguyen

(74) *Attorney, Agent, or Firm* — Andrus Intellectual Property Law, LLP

(57) ABSTRACT

A marine engine comprises a cylinder block that defines a cylinder bore; a piston that reciprocates in the cylinder bore under force of combustion in the marine engine; and a liner disposed in the cylinder bore between the piston and the cylinder block. The liner provides a running surface for the piston. The liner has a cylindrical liner body that is sized to fit snugly within the cylinder bore and a pair of diametrically opposing tabs axially extends from liner body into the cylinder bore. Methods of making a marine engine are also disclosed.

14 Claims, 9 Drawing Sheets

MARINE ENGINES HAVING A CYLINDER BLOCK WITH CYLINDER LINER

FIELD

The present disclosure relates to marine engines and particularly to marine engines having a cylinder block with one or more cylinder liners.

BACKGROUND

The following U.S. Patents are incorporated herein by reference in entirety:

U.S. Pat. No. 4,776,303 discloses a two cycle internal combustion engine having a cylinder liner. A fuel-air flow passage is provided from the crankcase to the exhaust bridge in the cylinder liner and the exhaust bridge in the cylinder block along the interface between the cylinder liner and the cylinder block. A plurality of apertures is provided through the cylinder liner communicating with the fuel-air flow passage. A second fuel-air flow passage is provided between the piston and the cylinder liner and in communication with the apertures to facilitate fuel-air mixture flow through the exhaust bridge to improve lubrication and cooling thereof.

U.S. Pat. No. 5,303,682 discloses a hypereutectic aluminum-silicon alloy cylinder bore liner produced by feeding the molten alloy into a metal mold having an inner shell sand cup, while rotating the mold at a speed in excess of 1,000 rpm, to cause the molten alloy to be thrown outwardly by centrifugal force to form a cylindrical liner. On solidification of the alloy, discrete silicon particles are precipitated and the use of the sand shell increases the fluid life of the alloy to enable the lighter weight silicon particles to migrate inwardly under the centrifugal force of rotation, to produce a solidified liner having a greater volume fraction of silicon particles in the inner portion of the liner where greater wear resistance is desired.

U.S. Pat. No. 7,000,584 discloses an engine provided with a plurality of cylinders and cylinder liners that are shaped to define a plurality of spaces between the liners and the cylinder block. These spaces provided an insulative barrier that at least partially restricts the flow of heat from the liner into the cylinder block. This allows the liners to operate at elevated temperatures while avoiding a deleterious increase in the cooling water temperature as it flows through passages within the cylinder block.

U.S. Pat. No. 7,191,770 discloses an engine made by providing a layer of material between the outer surface of a cylinder liner and the inner surface of the cylinder opening within a cylinder block. The material can be a polymer or a ceramic. Polyether ether ketone or polyethylene terephthalate can be a polymer used for these purposes. Zirconia or yttria can be ceramic used for these purposes. An electrodeposited paint can serve as the layer of thermally insulative material.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter. In examples disclosed herein, a marine engine comprises a cylinder block that defines a cylinder bore; a piston that reciprocates in the cylinder bore under force of combustion in the marine engine; and a liner disposed in the cylinder bore between the piston and the cylinder block. The liner provides a running surface for the piston. The liner has a cylindrical liner body that is sized to fit snugly within the cylinder bore and a pair of diametrically opposing tabs axially extends from liner body into the cylinder bore. Exemplary methods of making a marine engine are also disclosed herein.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

Figure 1:
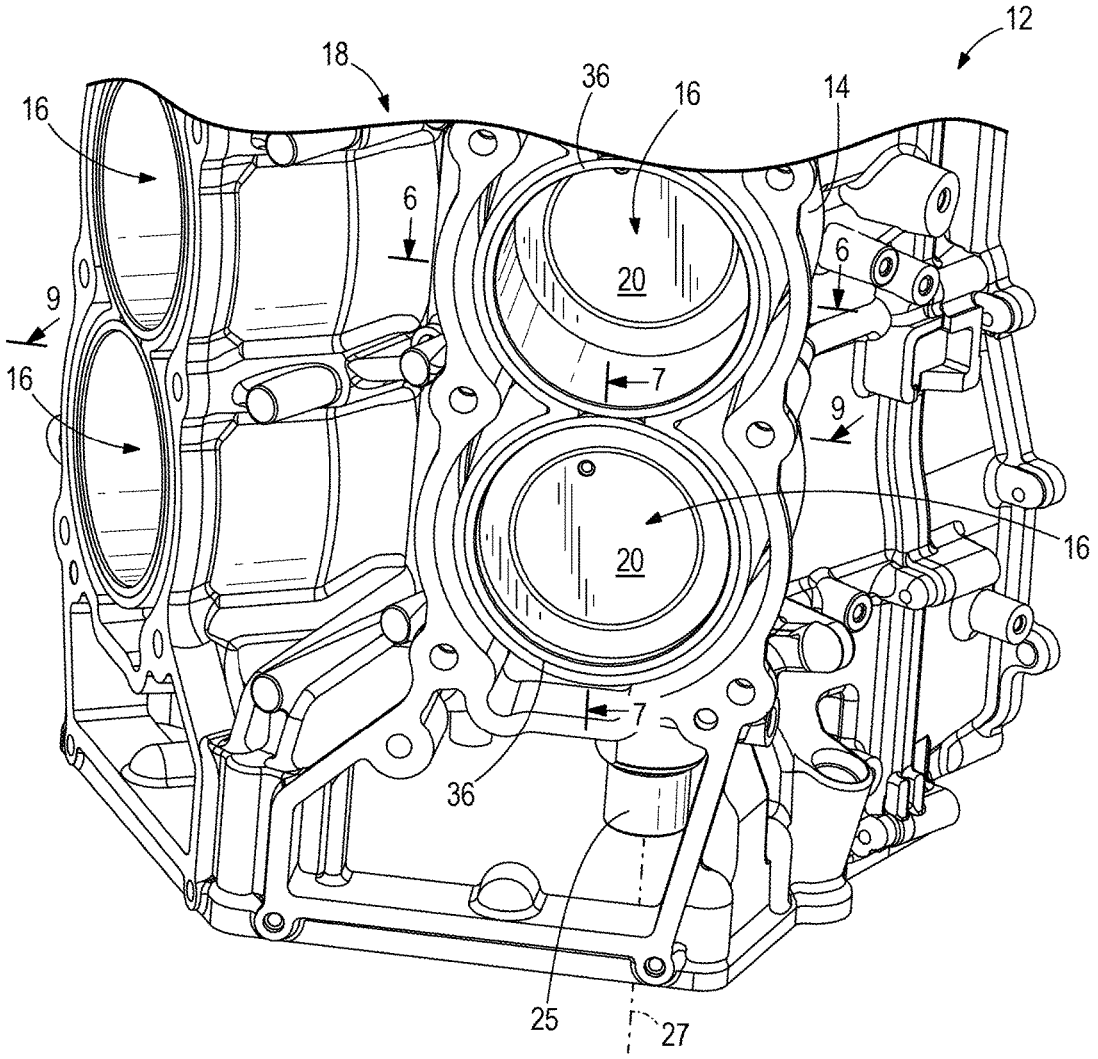
FIG. 1 is a partial perspective view of an exemplary marine engine according to the present disclosure.
Figure 2:
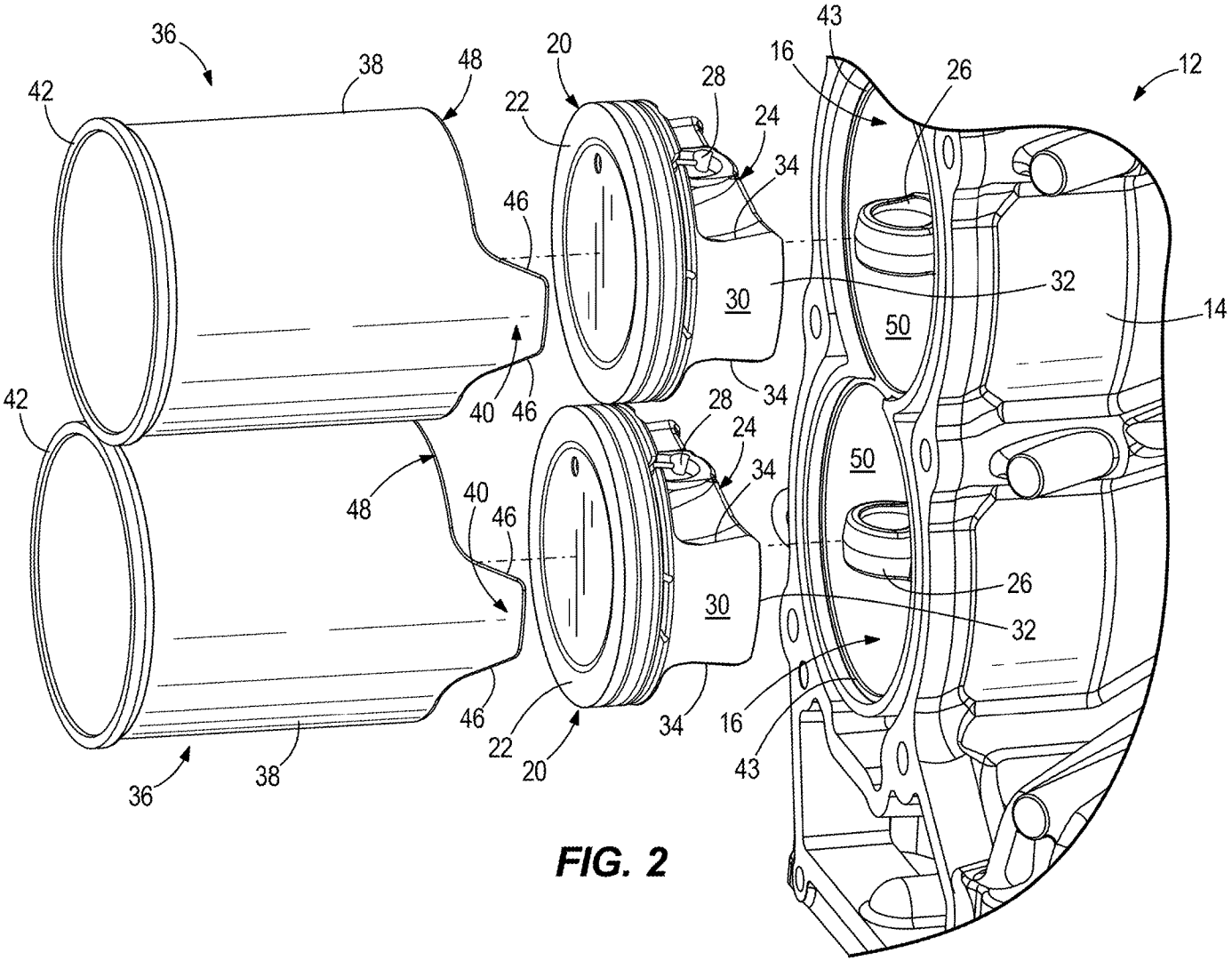
FIG. 2 is an exploded view of the marine engine including its cylinder block, wherein liners and pistons are shown removed from cylinder bores of the cylinder block.

FIGS. 1 and 2 depict lower portions of an outboard marine engine 12, including its cylinder block 14 and a plurality of cylinder bores 16 defined therein. Specifically, two banks of vertically-aligned cylinder bores 16 extend horizontally transversely to each other to form a conventional V-shape, which defines a valley 18. Each cylinder bore 16 contains a piston 20 that is configured to reciprocate in the cylinder bore 16 under force of combustion in the marine engine 12. It should be mentioned that the type and configuration of marine engine can vary from that which is shown and described. The concepts provided in the present disclosure are not limited for use with outboard marine engines and also are not limited for use with marine engines having a V-shape. For example, the concepts provided herein can be applied to stern drive or inboard configurations and/or the like and to inline engine configurations and/or the like.

Each piston 20 has a piston body (including peripheral sealing rings) 22 and a piston skirt 24 that axially extends from the piston body 22. A connecting rod 26 is disposed in the cylinder bore 16 and is coupled to the piston skirt 24 via a pin aperture 28 extending through the piston skirt 24. The connecting rod 26 connects the piston 20 to a vertically extending crankshaft 25 such that reciprocation of the pistons 20 in the cylinder bores 16 causes rotation of the crankshaft 25 about its own axis 27, all as is conventional. Each piston 20 is oriented in its respective cylinder bore 16 such that the pin aperture 28 is oriented parallel to the vertically extending axis 27. The piston skirt 24 has a pair of diametrically opposing side surfaces 30 that axially extend from the piston body 22. Each of the side surfaces 30 includes a bottom edge 32 and opposing side edges 34 that taper towards each other from the piston body 22 to the bottom edge 32.

Figure 3:
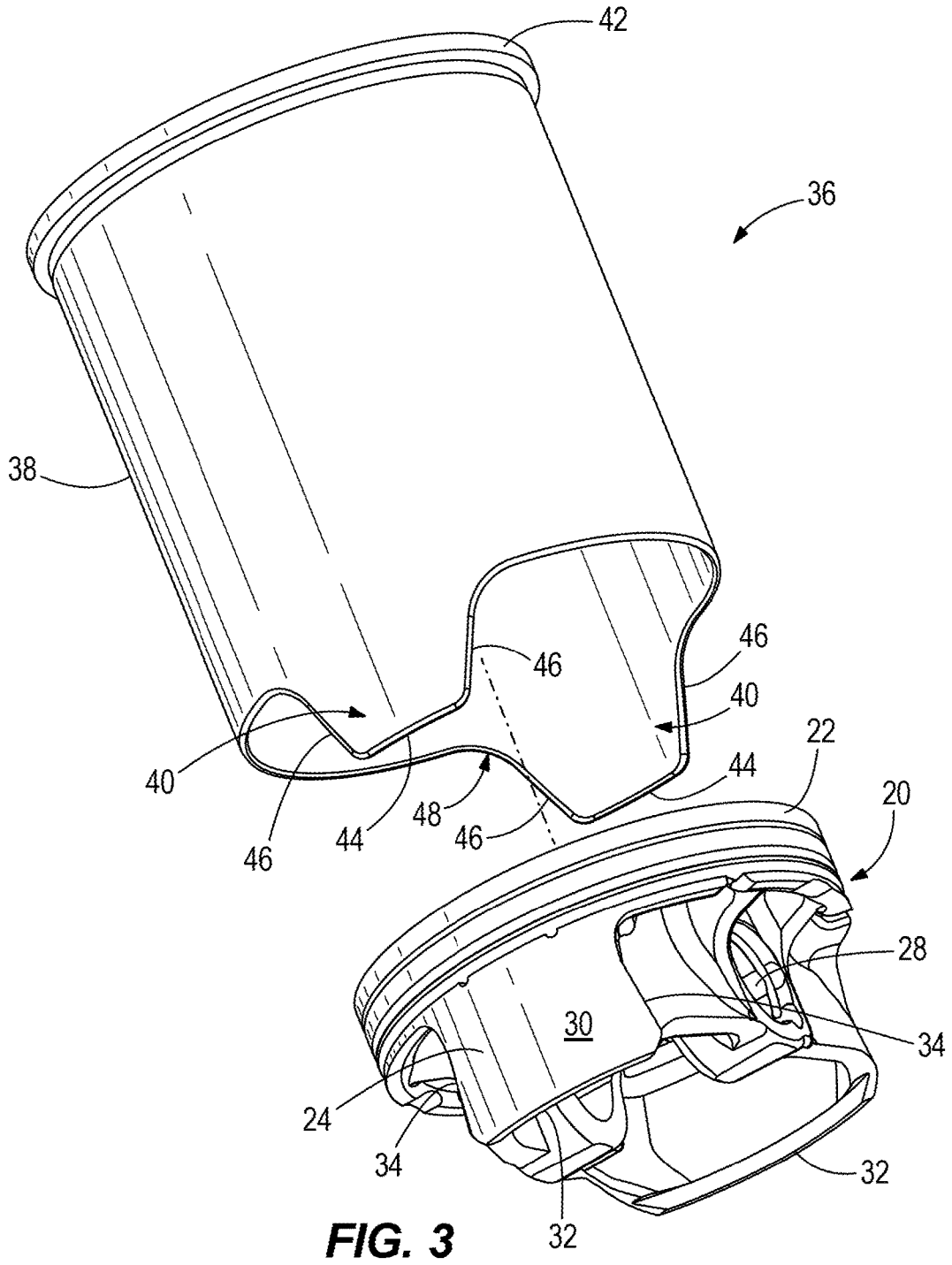
FIG. 3 is an exploded view of one of the liners and pistons.
Figure 5:
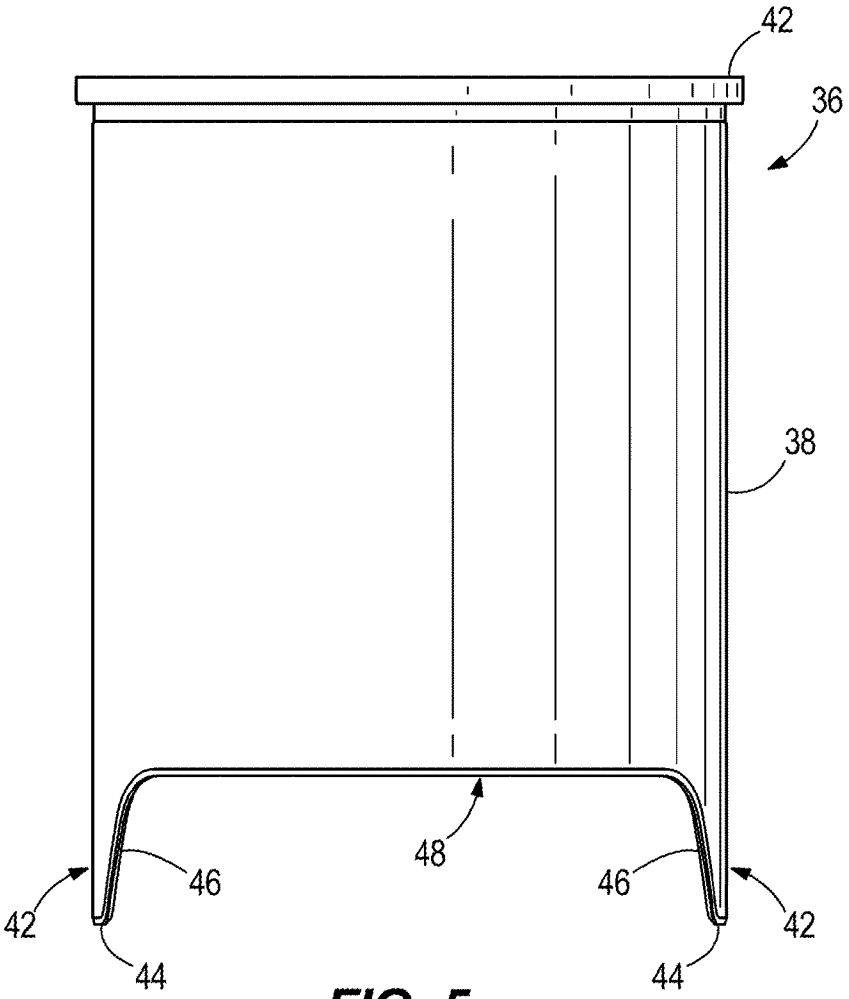
FIGS. 4 and 5 are side and front views of the liner.
Figure 4:
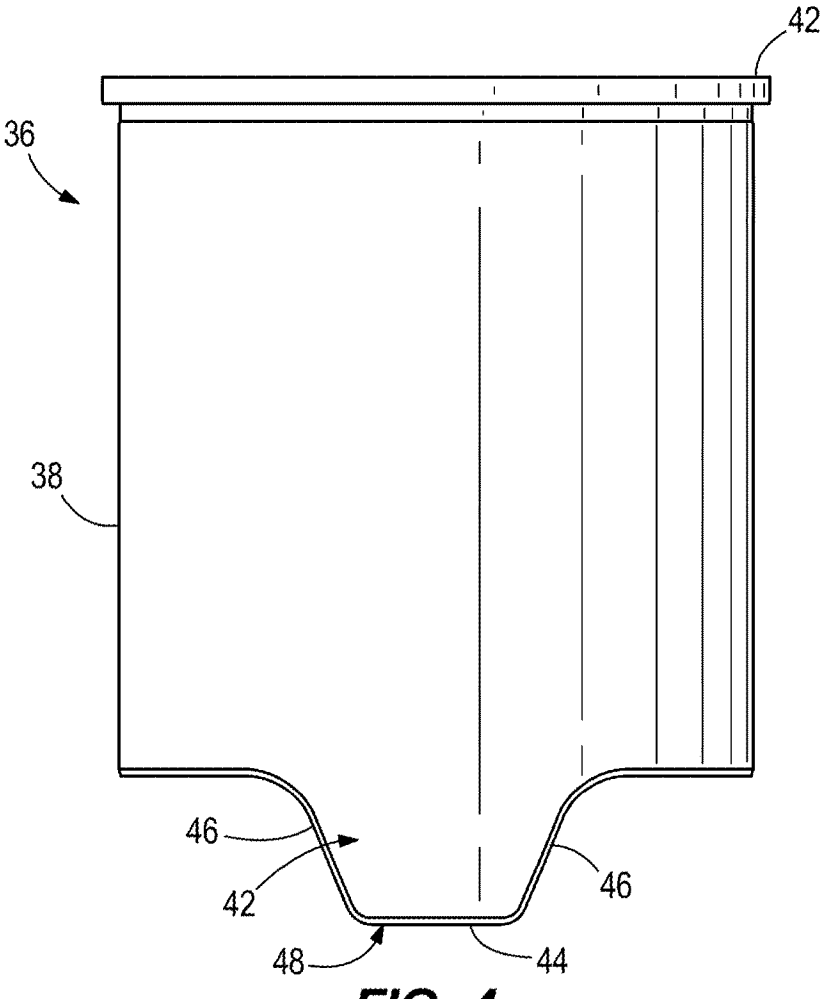
Figure 8:
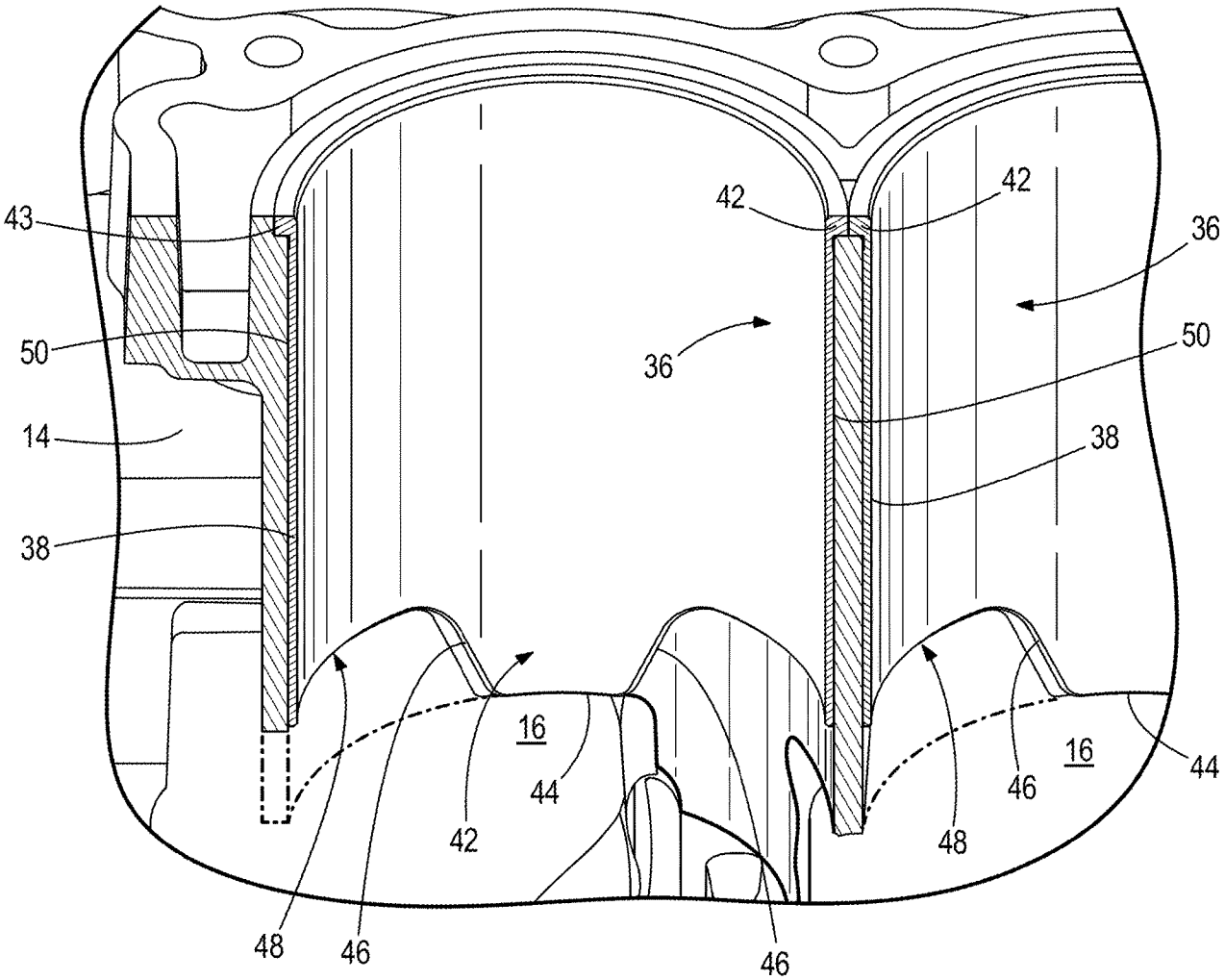
FIG. 8 is a sectional view of the liner and cylinder bore.

Referring to FIGS. 2-5, a liner 36 is disposed in each cylinder bore 16 and is disposed radially between the piston 20 and the cylinder block 14. The liner 36 provides a running surface for the piston 20. The liner 36 includes a cylindrical liner body 38 that is sized to snugly fit snugly within the cylinder bore 16. The liner 36 includes a peripheral flange 42 that engages with the cylinder block 14 to thereby suspend the liner 36 in the cylinder bore 16. More specifically, the peripheral flange 42 is configured to engage with a peripheral ledge 43 in the cylinder bore 16 to suspend the liner 36 in the cylinder bore 16. The liner 36 further includes a pair of diametrically opposing tabs 40 that axially extend from the liner body 38 into the cylinder bore 16. The opposing tabs 40 can optionally be shaped and sized the same as each other. Each has a bottom edge 44 and opposing side edges 46 that taper towards each other from the liner body 38 to the bottom edge 44. Referring to FIG. 3, the opposing tabs 40 are radially aligned and follow the contour of the side surfaces 30 on the piston skirt 24 so as to provide a bearing surface for the piston skirt 24 as the piston 20 reciprocates in the liner 36. That is, the liner body 38 is sized to radially abut and support the piston body 22 when the piston 20 is fully seated in the cylinder bore 16 and the opposing tabs 40 radially abut and support the piston skirt 24 and particularly the side surfaces 30 when the piston 20 is fully seated in the cylinder bore 16. The shape of the liner 36 is different than the conventional, fully cylindrically shaped liners. More specifically, the material that is normally peripherally outside of the opposing tabs 40 (see dash-and-dot line in FIG. 8) is omitted, thus saving weight in the liner 36, as compared to the prior art.

Figure 6:
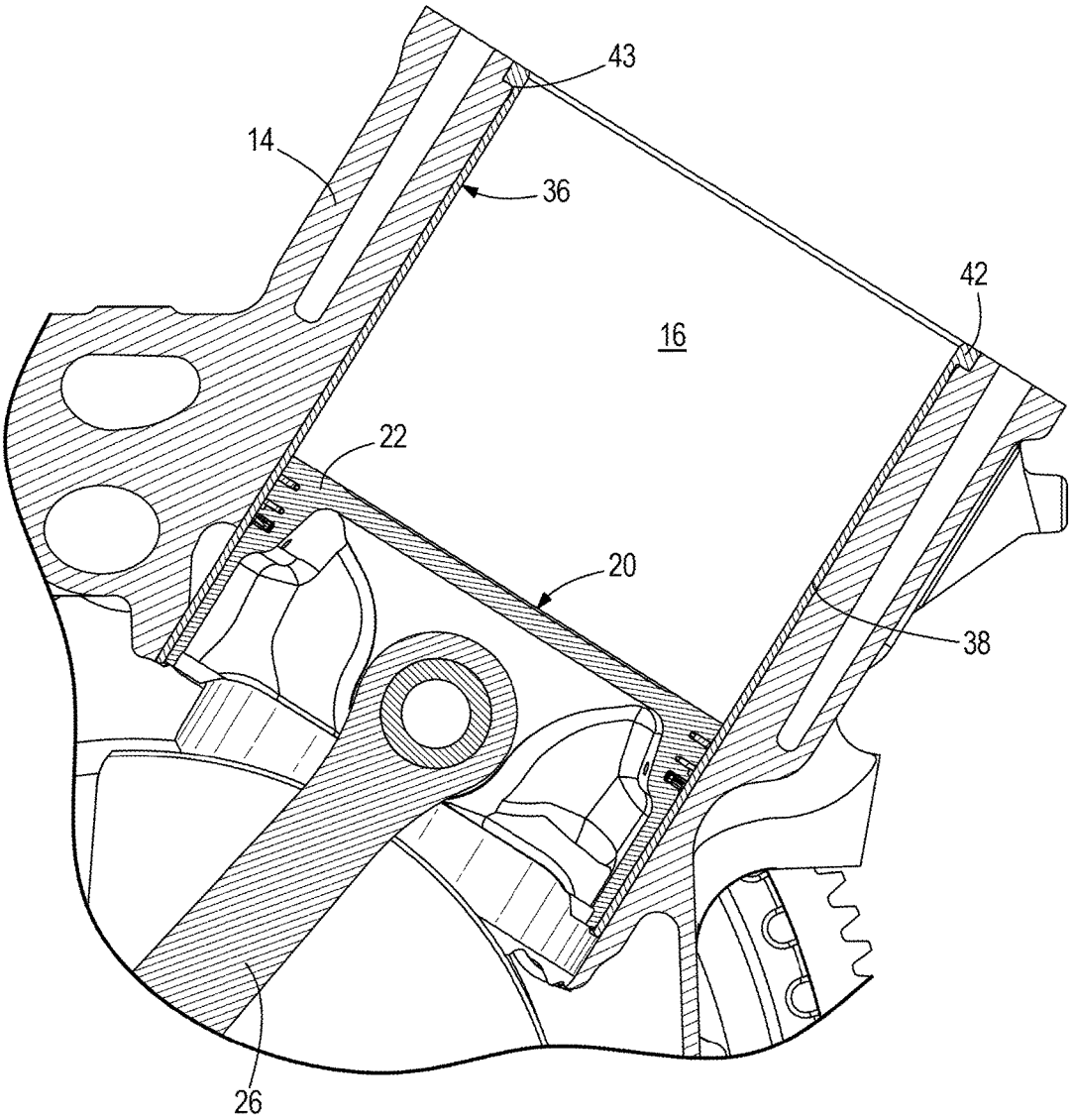
FIG. 6 is a view of Section 6-6 taken in FIG. 1.
Figure 7:
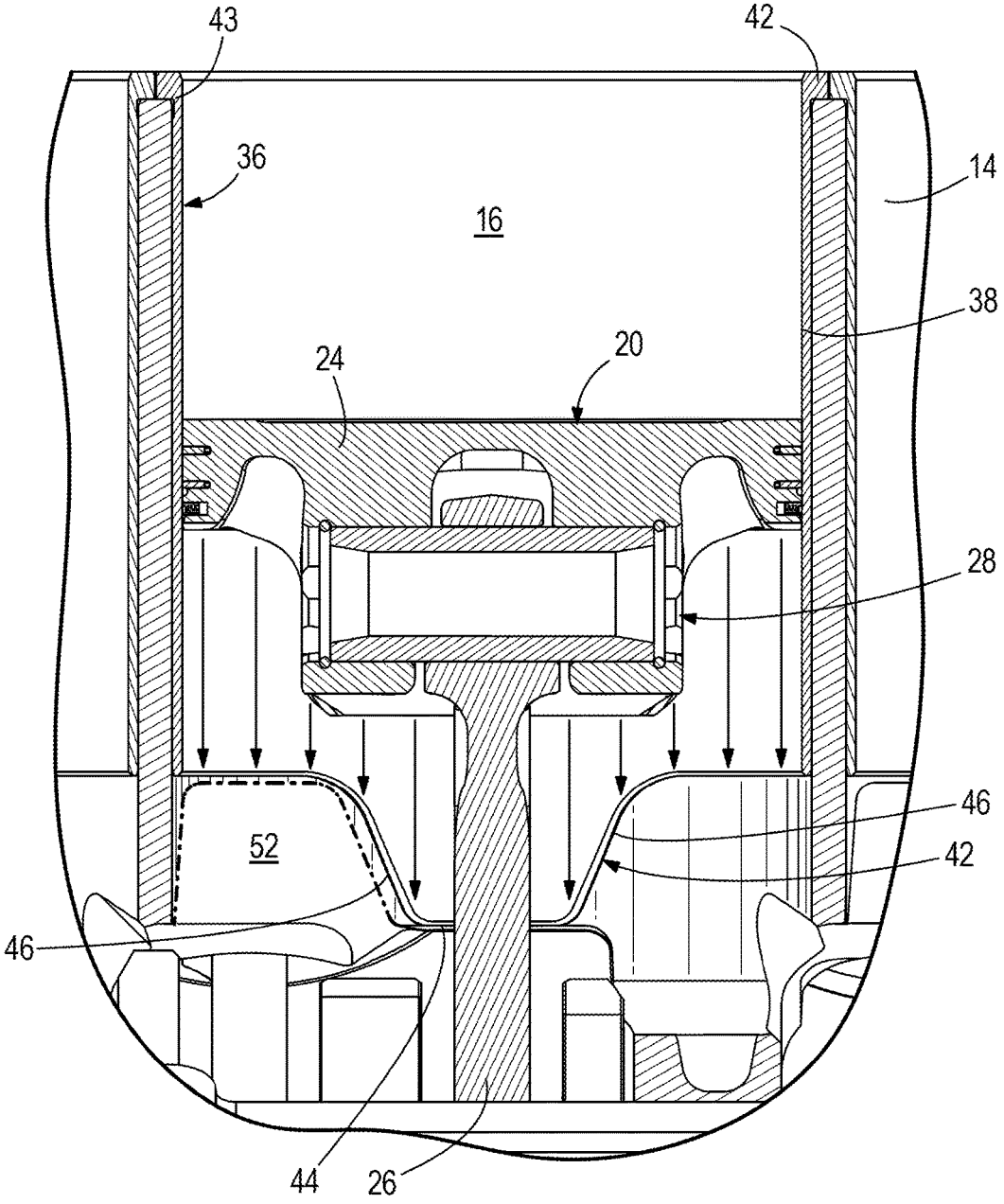
FIG. 7 is a view of Section 7-7 taken in FIG. 1.
Figure 9:
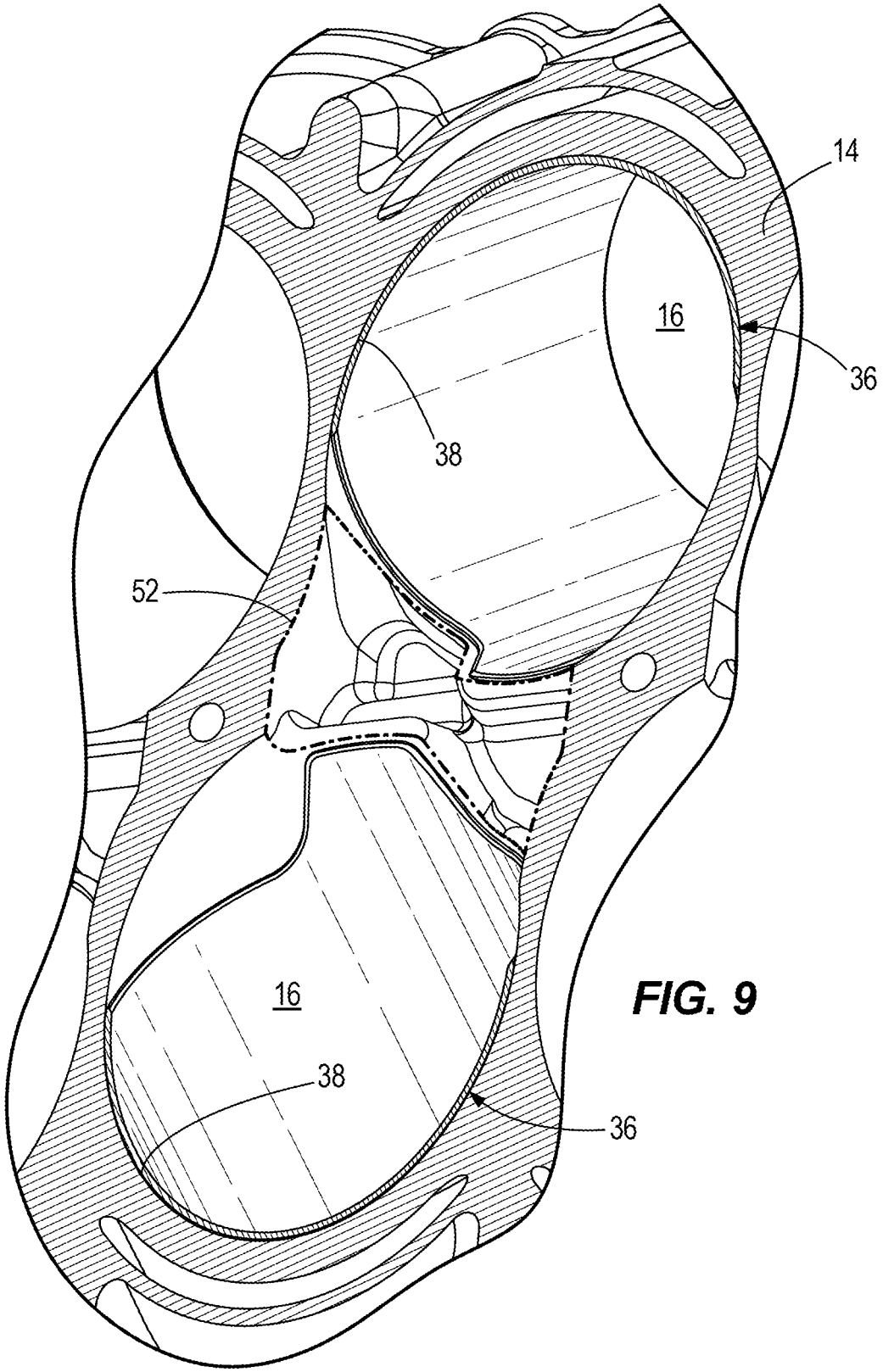
FIG. 9 is a view of Section 9-9 taken in FIG. 1.
Figure 10:
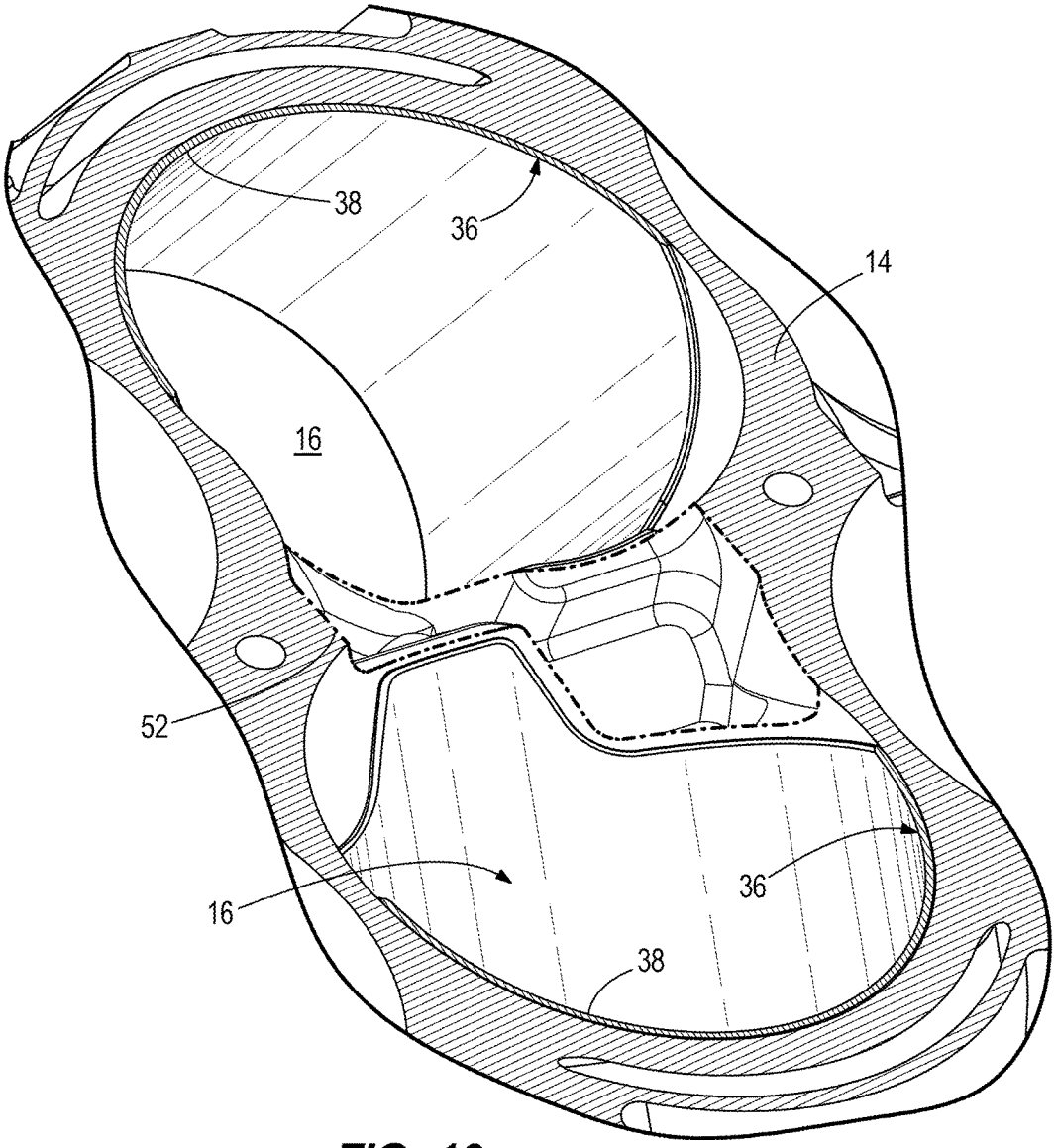
FIG. 10 is another sectional view of the liner and cylinder bore.

Referring to FIGS. 6 and 7, the liner 36 has a lower edge profile 48 along a lower edge of the liner 36, including the opposing tabs 40. The cylinder bore 16 forms a bearing surface 50 that radially abuts and supports the liner 36. The bearing surface 50 follows the lower edge profile 48 of the liner 36. More specifically, the cylinder bore 16 has recessed cutouts on opposing sides of each of the opposing tabs 40. The recessed cutouts 52 (see dash-and-dot line in FIGS. 7, 9 and 10) follow the lower edge profile 48 of the liner 36, including along the opposing tabs 40. The area of recessed cutouts 52 are typically solid material in conventional cylinder bores and thus provide a significant weight savings over the prior art. In some examples, the cylinder block 14 can be made of aluminum and the liner 36 can be made of iron.

The present disclosure thus provides a marine engine having a cylinder block that defines a cylinder bore, a piston that reciprocates in the cylinder bore under force of combustion in the marine engine, and a liner disposed in the cylinder bore between the piston and the cylinder block. The liner provides a running surface for the piston and includes a cylindrical liner body that is sized to fit snuggly within the cylinder bore and a pair of diametrically opposing tabs that axially extend from the liner into the cylinder bore. The piston has a piston body and a piston skirt. The piston skirt has a pair of diametrically opposing side surfaces that axially extend from the piston body. Each of the diametrically opposing side surfaces comprises a bottom edge and opposing side edges that taper towards each other from the piston body to the bottom edge. The pair of diametrically opposing tabs on the liner is radially aligned with the diametrically opposing side surfaces on the piston skirt so as to provide a bearing surface for the piston skirt as the piston axially reciprocates in the liner. The liner has a lower edge profile that extends peripherally around the cylindrical liner body, including along the pair of diametrically opposing tabs. The cylinder bore thus forms a bearing surface that radially abuts and supports the liner. The bearing surface follows the lower edge profile of the liner. Recessed cutouts are formed on opposite sides of each of the pair of diametrically opposing tabs. The recessed cutouts follow the lower edge of the profile of the liner so that the bearing surfaces radially abuts all portions of the liner, including the liner body and the pair of diametrically opposing tabs.

The present disclosure provides a method of making a marine engine including forming the cylinder block including the cylinder bore, providing the piston, which reciprocates in the cylinder bore under force of combustion, and disposing the liner in the cylinder bore between the piston and the cylinder block. The method includes forming recessed cutouts in the cylinder bore on opposite sides of each of the opposing tabs, which follow the lower edge profile of the liner so that the bearing surface radially abuts all portions of the liner, including the liner body and the pair of diametrically opposing tabs. These measures advantageously save weight of the liner and the cylinder block. The cylinder block can be formed of aluminum and the liner formed of iron.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A marine engine comprising:

a cylinder block that defines a cylinder bore;

a piston that reciprocates in the cylinder bore under force of combustion in the marine engine; and a liner disposed in the cylinder bore between the piston and the cylinder block, the liner providing a running surface for the piston and comprising a cylindrical liner body that is sized to fit snugly within the cylinder bore and further comprising a pair of diametrically opposing tabs that axially extend from liner body into the cylinder bore;

wherein each of the pair of diametrically opposing tabs comprises a bottom edge and opposing side edges that extend from the liner body to the bottom edge wherein the piston comprises a piston body and a piston skirt, and wherein the piston skirt comprises a pair of diametrically opposing side surfaces that axially extend from the piston body, each of the diametrically opposing side surfaces comprising a bottom edge and opposing side edges extending from the piston body to the bottom edge;

wherein the pair of diametrically opposing tabs on the liner is radially aligned with the diametrically opposing side surfaces on the piston skirt so as to provide a bearing surface only for the diametrically opposing side surfaces of the piston skirt as the piston axially reciprocates in the liner.

2. The marine engine according to claim 1, wherein the liner comprises a peripheral flange that engages with the cylinder block to suspend the liner in the cylinder bore.

3. The marine engine according to claim 1, wherein the pair of diametrically opposing tabs are shaped and sized the same as each other.

4. The marine engine according to claim 1, further comprising a connecting rod disposed in the cylinder bore and coupled to the piston skirt, the connecting rod being configured to connect the piston to a vertically extending crankshaft in the marine engine.

5. The marine engine according to claim 4, further comprising a pin aperture radially extending through the piston skirt, the pin aperture being configured to facilitate connection of the piston to the connecting rod.

6. The marine engine according to claim 5, wherein the piston is oriented in the cylinder bore so that the pin aperture extends parallel to the vertically extending crankshaft.

7. A marine engine comprising:

a cylinder block that defines a cylinder bore;

a piston that reciprocates in the cylinder bore under force of combustion in the marine engine; and a liner disposed in the cylinder bore between the piston and the cylinder block, the liner providing a running surface for the piston and comprising a cylindrical liner body that is sized to fit snugly within the cylinder bore and further comprising a pair of diametrically opposing tabs that axially extend from liner body into the cylinder bore;

wherein the liner has a lower edge profile that extends peripherally around the cylindrical liner body, including along the pair of diametrically opposing tabs, and wherein the cylinder bore forms a bearing surface that radially abuts and supports the liner, wherein the bearing surface follows the lower edge profile of the liner; and wherein the cylinder bore has recessed cutouts forming open areas on opposite sides of each of the pair of diametrically opposing tabs.

8. The marine engine according to claim 7, wherein the recessed cutouts follow the lower edge profile of the liner so that the bearing surface radially abuts all portions of the liner, including the liner body and the pair of diametrically opposing tabs.

9. The marine engine according to claim 7, wherein the cylinder block is made of aluminum and wherein the liner is made of iron.

10. The marine engine according to claim 7, wherein the cylinder bore is one of a plurality of cylinder bores that are vertically aligned and extend horizontally transversely to each other in a V-shape forming a valley there between.

11. A marine engine comprising:

a cylinder block that defines a cylinder bore;

a piston that reciprocates in the cylinder bore under force of combustion in the marine engine;

a liner disposed in the cylinder bore between the piston and the cylinder block, the liner providing a running surface for the piston and comprising a cylindrical liner body that is sized to fit snugly within the cylinder bore and further comprising a pair of diametrically opposing tabs that axially extend from liner body into the cylinder bore;

wherein the piston comprises a piston body and a piston skirt, and wherein the piston skirt comprises a pair of diametrically opposing side surfaces that axially extend from the piston body, each of the diametrically opposing side surfaces comprising a bottom edge and opposing side edges that extend from the piston body to the bottom edge;

wherein the pair of diametrically opposing tabs on the liner is radially aligned with the diametrically opposing side surfaces on the piston skirt so as to provide a bearing surface for the piston skirt as the piston axially reciprocates in the liner;

wherein liner has a lower edge profile that extends peripherally around the cylindrical liner body, including along the pair of diametrically opposing tabs, and wherein the cylinder bore forms a bearing surface that radially abuts and supports the liner, wherein the bearing surface follows the lower edge profile of the liner;

wherein the cylinder bore has recessed cutouts forming open areas on opposite sides of each of the pair of diametrically opposing tabs and wherein the recessed cutouts follow the lower edge profile of the liner so that the bearing surface radially abuts all portions of the liner, including the liner body and the pair of diametrically opposing tabs.

12. The marine engine according to claim 11, wherein the liner comprises a peripheral flange that engages with the cylinder block to suspend the liner in the cylinder bore.

13. The marine engine according to claim 11, wherein the pair of diametrically opposing tabs are shaped and sized the same as each other.

14. The marine engine according to claim 11, wherein the cylinder bore is one of a plurality of cylinder bores that are vertically aligned and extend horizontally transversely to each other in a V-shape forming a valley there between.

* * * * *